US005831652A

United States Patent [19]

Hinami et al.

[11] Patent Number: 5,831,652

[45] Date of Patent: Nov. 3, 1998

[54] MEMBER AND METHOD FOR PROTECTING INK TANK

[75] Inventors: Jun Hinami, Kawasaki; Sadayuki Sugama, Tsukuba; Hirofumi Okuhara, Tokyo, all of Japan

[73] Assignee: Canon Kabushiki Kaisha, Tokyo, Japan

[21] Appl. No.: 606,947

[22] Filed: Feb. 26, 1996

[30] Foreign Application Priority Data

Feb. 28, 1995 [JP] Japan ..... 7-040379

[51] Int. Cl.[6] ..... B41J 2/175

[52] U.S. Cl. ..... 347/86; 53/410; 206/497

[58] Field of Search ..... 347/84, 85, 86, 347/87; 53/410, 139.5, 139.6, 139.7; 206/497, 523, 722, 701, 1.9

[56] References Cited

U.S. PATENT DOCUMENTS

| | | | |
|---|---|---|---|
| 4,695,824 | 9/1987 | Tazaki | 347/86 |
| 5,148,920 | 9/1992 | Walker | 206/523 |
| 5,557,310 | 9/1996 | Kurata et al. | 347/87 |
| 5,701,995 | 12/1997 | Higuma et al. | 206/205 |

FOREIGN PATENT DOCUMENTS

| | | |
|---|---|---|
| 0418828 | 3/1991 | European Pat. Off. . |
| 0547874 | 6/1993 | European Pat. Off. . |
| 0576237 | 6/1993 | European Pat. Off. . |
| 0627317A1 | 7/1994 | European Pat. Off. . |
| 62-019460 | 1/1987 | Japan . |
| 06210871 | 8/1994 | Japan . |
| 06328712 | 11/1994 | Japan . |
| 06328713 | 11/1994 | Japan . |

*Primary Examiner*—N. Le
*Assistant Examiner*—Judy Nguyen
*Attorney, Agent, or Firm*—Fitzpatrick, Cella, Harper & Scinto

[57] ABSTRACT

A method and a member, by the provision of a simple structure, protect the elastic latch nail of an ink tank from external shocks, and/or prevent ink leakage from the ink tank. The ink tank protection member comprises a sealing tape 320 having a tab portion 325 needed for peeling it off, and an elastic latch nail fixing member 360 provided on the sealing tape to be nipped between the elastic latch nail 310 of the ink tank and the main body of the ink tank 350.

13 Claims, 8 Drawing Sheets

MEMBER AND METHOD FOR PROTECTING INK TANK

BACKGROUND OF THE INVENTION

1. Field of the Invention

The present invention relates to a protection member and a protection method for covering the supply opening of an ink tank in order to prevent ink leakage from the supply opening at the time of the ink tank retaining ink to be supplied to an ink jet head being left unmounted. Particularly, the invention relates to a protection member and a protection method for protecting an installation member for mounting an ink tank on an apparatus which is provided on the ink tank at the same time that it prevents ink leakage from the ink supply opening of the ink tank.

2. Related Background Art

In the ink jet technical field, the form of ink tanks has changed along the miniaturization of recording apparatuses. A form capable of detachably mounting an ink tank not only on a carriage provided for an apparatus, but also on a recording head, has been increased in recent years.

As one example of an ink tank having such form, there is known the structure of the ink tank as shown in FIG. 1. The tank comprises a rectangular main body 101 and an ink supply opening 102 arranged on the one side face 101*a* of the main body for connecting the tank with an ink jet head to supply ink, as shown in FIG. 1. Also, on the side face 101*b*, opposite to the side face where the ink supply opening 102 is arranged, an atmosphere communicating opening (not shown) is arranged to communicate the interior of the ink tank with the atmosphere, thus contributing to keeping the ink supply in an appropriate condition. Further, on the side face of the ink tank 101 where the ink supply opening 102 is arranged, engaging members 104 are provided in a form of being extruded outwardly in order to maintain the engagement of the ink tank with the ink jet head.

The ink supply opening of the ink tank having in such form is sealed at least with a seal 103 in order to avoid any ink leakage, particularly from the ink supply opening, before the ink tank is mounted on the ink jet head.

When this ink tank is mounted on the carriage arranged for an apparatus, the engaging members 104 engage with the corresponding portions to be engaged on the ink jet head side to fix the tank on it. At this time, the structure is made in such a manner that the ink tank is supported by means of a member arranged on the carriage to engage with a part of the ink tank, and good attachment and detachment of the ink tank is performed with respect to the ink jet head.

Meanwhile, as other forms of the ink tank, there have been proposed the ones as shown in FIGS. 2 and 3. In the ink tanks of these forms, a means for holding an ink tank in a head cartridge is proposed in such a manner that an elastic latch nail is provided on the surface of an ink tank to be engaged when the ink tank is mounted on the head cartridge, and the ink tank is holed therein by the elasticity of the latch nail. Since the means has an attaching and detaching mechanism using an elastic latch nail, it is possible to make the ink tank itself smaller still, thus minimizing the space required for performing the attachment and detachment.

FIG. 2 is a perspective view for showing a head cartridge 60 housing only a black ink tank 30 and integrally holding a recording head (BHD) dedicated to recording in black. FIG. 3 is a perspective view for showing a head cartridge 160 housing black and color ink tanks 130 and 140, respectively and integrally holding a recording head (BCHD) for carrying out black and color recordings together.

As shown in FIG. 2, the black ink tank 30 has a black triangle mark 206*a* and a yellow triangle mark 207*a* provided on the upper surface thereof for the purpose of visual recognition of its presence or absence when the ink tank is mounted on a carriage (not shown). Also, an elastic latch nail 32*a* is provided on the engaging surface of the ink tank at the time of mounting it on a head cartridge 60. On the side opposite to the side where the elastic latch nail 32*a* is provided, a dropping off-stopping nail 32*d* is provided. In the head cartridge 60, there are arranged a pop-up spring 68 for pushing up the black ink tank 30, when the black ink tank 30 is detachably mounted and an ink induction portion 70 to be connected with the ink supply opening of the ink tank for supplying ink to the head.

The ink tank and head cartridge shown in FIG. 3 are of the same structure as shown in FIG. 2 except for providing two ink tanks whose volumes and inner structures are different from each other. A reference numeral 130 designates a black ink tank; 140, a color ink tank retaining three kinds of color ink, yellow, magenta, and cyan in it; 132*e* and 142*e*, elastic latch nails arranged for each ink tank; 132*d* and 142*d*, dropping off-stopping nails; and 206*a* and 207*a*, triangle marks, respectively.

Also, a reference numeral 160 designates the head cartridge that is partitioned by a wall 165 to make it possible to house two ink tanks, and that also is provided with a head (BCHD) capable of discharging ink in each of black, yellow, magenta, and cyan colors, respectively. Further, the head cartridge 160 is provided with pop-up springs 68*c* (one on the black side is not shown), and with ink induction portions 170*b*, 170*y*, 170*m*, and 170*c*. By structure described above, it is possible to perform the close contact between the ink supply opening (not shown) of the tank and the supply portion of the head cartridge just by one touch in good condition when the ink tanks 30, 130, and 140 are mounted on the head cartridges 60 and 160. Also, at the time of removing the ink tanks, it is possible to perform the removal just by one action. Moreover, the removal is easily performed with the minimum requirement of space.

As described above, for the ink tank of an extremely small printer, the method of attachment and detachment made by means of the engaging member or the elastic latch nail mechanism as described above is effective. In the form of the engaging member as shown in FIG. 1, the member itself is structured to be short and comparatively strong against deformation. As a result, there is no need for handling the member with any particular care.

On the other hand, the ink tank provided with the elastic latch nail is subjected to external shock during its delivery or in a state of being unmounted, because the long arm of the elastic latch nail extends outwardly. In this case, the elastic latch nail is apt to be damaged or deformed extremely, leading to the incomplete mounting of the ink tank on the head cartridge. As a result, a hindrance may take place in stabilizing ink supply. In such case, because its incomplete mounting, air bubbles are carried into the interior of the head or, in the worst case, printing becomes disabled. If such damage is very serious, there is a fear that the ink tank becomes unusable.

Meanwhile, for a detachably mountable ink tank, it is preferable to prevent ink leakage from the ink supply opening of an ink tank during the delivery or in a state of being left unmounted. Particularly, for an extremely small ink tank, it is should be considered to prevent any ink leakage ideally, because the initial filling of ink is limited to a small quantity, and the ink amount in the ink tank tends to be reduced even by an extremely small amount of splashing of ink into the cap or the like.

Further, for a cartridge for color printing use, it is usually practiced as an effective means to integrate three colors, yellow, magenta, and cyan, in a color ink tank in order to implement the provision of a smaller printer. Therefore, when such ink tank that retains three colors together should be protected by use of protecting members, there is encountered a problem that the mixture of ink colors take place due to ink splashing. It is possible to individually seal each ink supply opening of color inks with a sealing member, but in this case, not only it costs extra labor and expenses in sealing, but also the user is required to do a complicated work in peeling off each individual sealing member (protection member) thus provided.

SUMMARY OF THE INVENTION

A main object of the present invention is to provide a protection method by means of a simple structure for protecting the above-mentioned elastic latch nail of an ink tank from external shocks.

In addition to the main object of the present invention described above, another object of the invention is to provide a method and a member for preventing ink leakage from the ink tank and ink splashing onto the interior of the cap, while protecting the elastic latch nail that functions as an attachment and detachment mechanism of a small ink tank, and also to provide an ink tank having the member.

Still another object of the invention is to provide an ink tank protection method for closing the ink supply opening provided on the bottom face of an ink tank, and holding the elastic latch nail provided on the face adjacent to the bottom face in a state of being substantially fixed, wherein the closing of the ink supply opening and the substantially fixed holding of the elastic latch nail are performed by one and the same means.

A further object of the invention is to provide an ink tank protection member comprising means for closing the ink supply opening provided on the bottom face of an ink tank, and means for holding the elastic latch nail provided on the face adjacent to the bottom face in a state of being substantially fixed, wherein the means for closing the ink supply opening dually functions as means for holding the elastic latch nail in a state of being substantially fixed.

Still a further object of the invention is to provide an ink tank protection member comprising means for sealing the communicating groove provided on the upper surface of the ink tank for communicating the interior with the exterior; means for closing the ink supply opening provided on the bottom face of the ink tank; and means for holding the elastic latch nail provided on the face adjacent to the bottom face in a state of being substantially fixed, wherein the means for closing the ink supply opening is structured with the same member functioning as means for sealing the communicating groove, and only the member for sealing the communicating groove is not peeled off when the means for closing the ink supply opening is removed.

In the present invention, the closing of an ink supply opening and the substantially fixed holding of an elastic latch nail can be performed by one and the same means, and therefore no extra costs are incurred. The user can also remove the ink tank protection member easily by one action at the time of using the ink tank.

Also, the member for fixing the elastic latch nail is provided between the elastic latch nail and the face of the wall of an ink tank, making it possible to protect the elastic latch nail from external shocks.

Further, for means for closing the ink supply opening, a shock relieving material or an absorbent shock relieving member is used. Therefore, it is possible to minimize the amount of ink splashing from the ink supply opening due to external shocks during the delivery of the ink tank or in a state of being left unmounted. In this way, the amount of usable ink is prevented from being reduced. There is also no possibility that the ink tank is stained even when ink splashes.

BRIEF DESCRIPTION OF THE DRAWINGS

FIG. 5A shows a tape for preventing ink leakage provided with a member for fixing an elastic latch nail; FIG. 5B is a side view of the tape shown in FIG. 5A when it is applied to an ink tank; and FIG. 5C is a perspective view of FIG. 5B.

FIG. 6A and FIG. 6B schematically illustrate the ink tank protection member; and FIG. 6C is a side view of the ink tank protection member when it is applied to the ink tank.

FIG. 9A illustrates the ink tank protection member; FIG. 9B shows a state where an elastic latch fixing member is attached to the ink tank protection member represented in FIG. 9A.

FIG. 10A illustrates a state before installation; and FIG. 10B shows a state where the ink tank protection member is applied.

DETAILED DESCRIPTION OF THE PREFERRED EMBODIMENTS

Hereinafter, with reference to the accompanying drawings, the embodiments of the present invention will be described below.

(First Embodiment)

Figure 4:
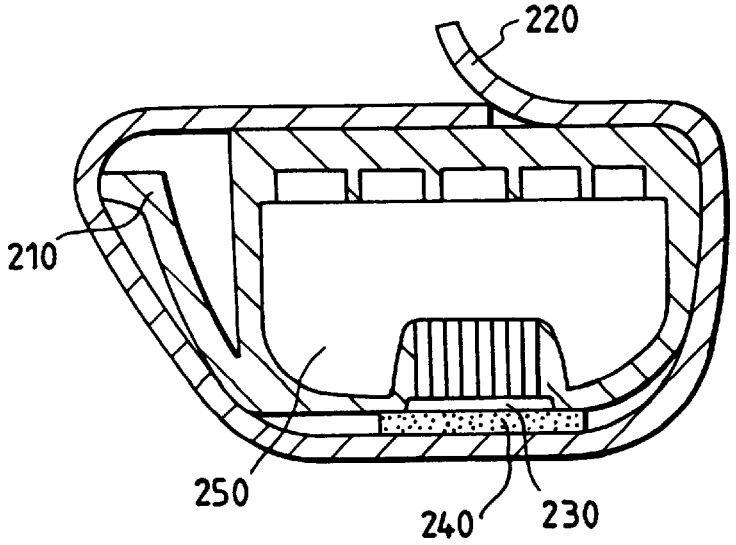
FIG. 4 is a cross-sectional view which shows one structural example in which the protection of an elastic latch nail and the closing of the ink supply opening of an ink tank are performed simultaneously.

FIG. 4 is a cross-sectional view for showing one structural example in which the protection of an elastic latch nail and the closing of the supply opening of an ink tank are performed simultaneously.

As shown in FIG. 4, a protection tape 220 capable of performing the protection of the elastic latch nail 210 and the closing of the ink supply opening of the ink tank is wound around an ink tank 250. A sealing member 240 is provided on the portion of the tape where the sealing tape abuts upon the ink supply opening 230 of the ink tank.

By the structure described above, it is possible to protect the elastic latch nail 210 and close the ink supply opening 230 of the ink tank at the same time. It is also possible to eliminate any causes that may break the elastic latch nail 210 due to the exertion of force acting upon it outwardly.

Further, the description will be made of a method for fixing and protecting an elastic latch nail.

Figure 5A:
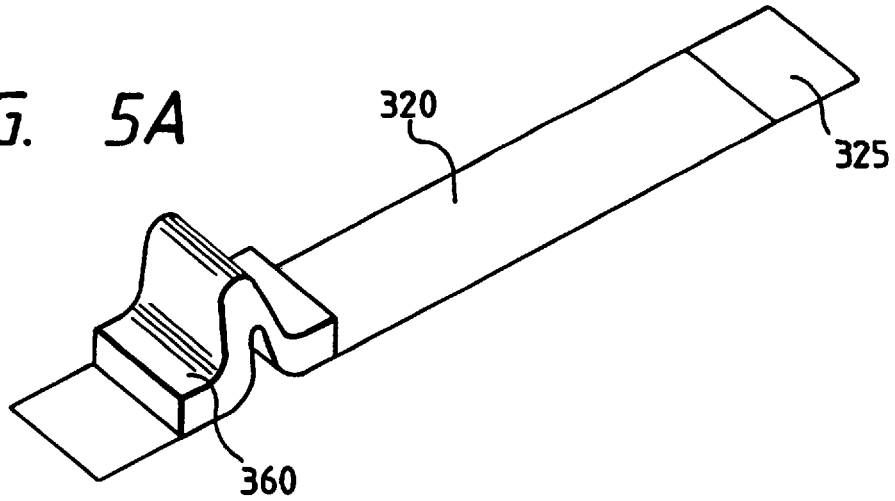
FIGS. 5A to 5C are views showing the other structural examples of the elastic nail and ink tank holding member in accordance with for the first embodiment of the present invention.
Figure 5B:
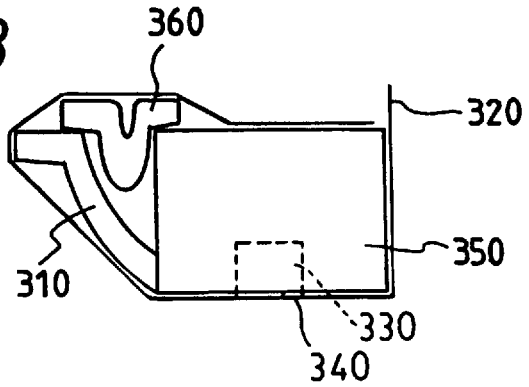
Figure 5C:
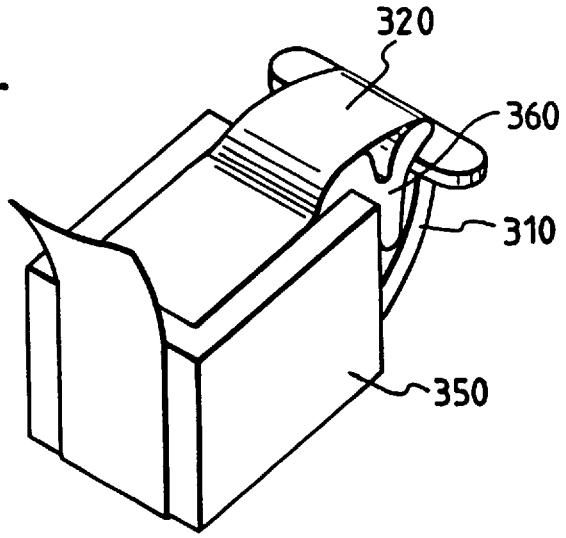

FIGS. 5A to 5C illustrate an elastic latch nail and ink tank protection member in accordance with the present embodiment. FIG. 5A shows a tape for preventing ink leakage provided with an elastic latch nail fixing member. FIG. 5B is a side view illustrating the tape shown in FIG. 5A in a state that the tape is applied to an ink tank. FIG. 5C is a perspective view of FIG. 5B.

The ink tank protection member shown in FIG. 5A comprises a sealing tape 320 having a tab portion 325 needed for peeling off the sealing tape; and an elastic latch nail fixing member 360 provided on the sealing tape 320 to be nipped between the elastic latch nail 310 of the ink tank and the main body of the ink tank 350 when the sealing tape 320 is applied to the ink tank.

In order to wind the ink tank protection member described above around the ink tank, the ink supply opening 330 of the ink tank 350 provided on the bottom face of the ink tank 350 should be closed as illustrated in FIGS. 5B and 5C, and then, wind the sealing tape 320 around the ink tank 350 so that the elastic latch nail fixing member 360 is nipped between the elastic latch nail 310 of the ink tank 350 and the main body of the ink tank 350.

As an elastic latch nail fixing member 360, it is preferable to use a solid elastic material, spongy porous material, or the like. Also, in FIGS. 5A to 5C, whereas the elastic latch nail fixing member 360 and sealing tape 320 are arranged as separate members to form the ink tank protection member, it is possible to make the ink tank protection member from one elastically deformative material or the like so that the protection member is integratedly formed by a single material and a part of which is nipped between the elastic latch nail and the main body of the ink tank. In this case, it is possible to similary protect the elastic latch nail. Here, it is needless to mention that a sealing member 340 can be provided on the portion where the ink tank protection member closes the supply opening 330 of the ink tank as shown in FIG. 5B.

Figure 6A:
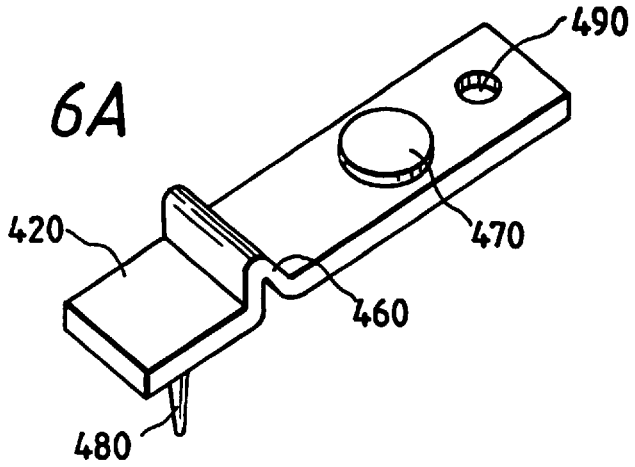
FIGS. 6A to 6C are views showing still another example of an ink tank protection member.
Figure 6B:
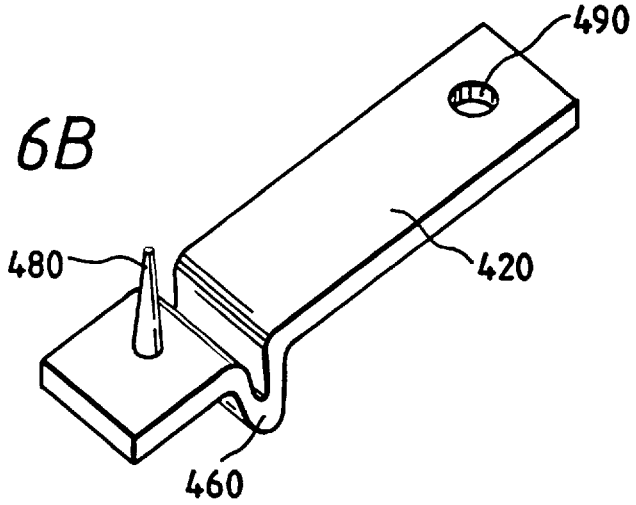
Figure 6C:
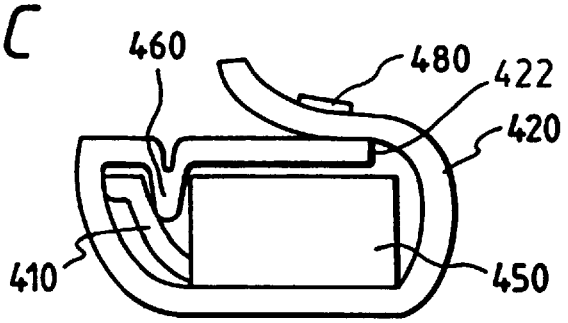

FIGS. 6A to 6C are views for showing one example where an ink tank protection member is formed by a single member: FIGS. 6A and 6B illustrate an ink tank protection member; and FIG. 6C is a side view showing a state that the ink tank protection member illustrated in FIGS. 6A and 6B is applied to the ink tank.

The ink tank protection member shown in FIGS. 6A to 6C is formed by an elastically deformative member 420. The elastically deformative member 420 comprises an elastic latch nail fixing member 460 provided to be nipped between the elastic latch nail 410 of the ink tank and the main body of the ink tank 450 when the elastically deformative member 420 is applied to the ink tank; an ink supply opening sealing member 470 for closing the ink supply opening (not shown) of the ink tank 450; and a pin 480 and a hole 490 for fixing the elastically deformative member 420 to the ink tank 450 by engaging the pin with the hole.

In order to wind the ink tank protection member described above around the ink tank, the ink supply opening of the ink tank arranged on the bottom face of the ink tank 450 should be closed by means of the ink tank supply opening sealing member 470 as shown in FIG. 6C, and then, the elastically deformative member 420 is wound around the ink tank 450 so that the elastic latch nail fixing member 460 is nipped between the elastic latch nail 410 of the ink tank 450 and the main body of the ink tank 450. After winding, the pin 480 is inserted into the hole 490 to engage them with each other. Thus the protection member can be applied easily. Further, the upper portion of the pin 480 is fixed by means of a thermal caulking, ultrasonic caulking, or the like. By this, the protection member can be applied easily and reliably. Also, the user can remove the protection member easily just by tearing off the caulked portion.

As described above, by forming an ink tank protection member with a single member, the structure of the protection member becomes simpler, and it can have a form that the protection member is peeled off just by one action.

Additionally, there is also a possibility in some cases that an ink tank protection member becomes loose or slacken off due to the vibrations given during delivery or environmental changes such as temperature and humidity changes in some cases. In order to eliminate such possibility, it is preferable to wind the ink tank protection member around the ink tank with some additional overlap (in other words, the leading end 421 of the protection member overlaps the trailing end 422 in the winding direction). By such structure, it becomes possible to protect an ink tank more reliably, and enable the protection member to withstand external shocks and environmental changes simultaneously.

Also, there is anticipated an event that an elastic latch nail is extremely deformed toward the main body of the ink tank if the elastic latch nail is fixed only by use of a sealing tape for a long time during delivery or in a state of being left unmounted. However, this problem can be solved by the provision of an elastic latch nail fixing member arranged between the elastic latch nail and the main body of the ink tank as in the present embodiment.

(Second Embodiment)

As a second embodiment, an ink tank protection method for a ink tank for color printing will be described bellow.

Figure 1:
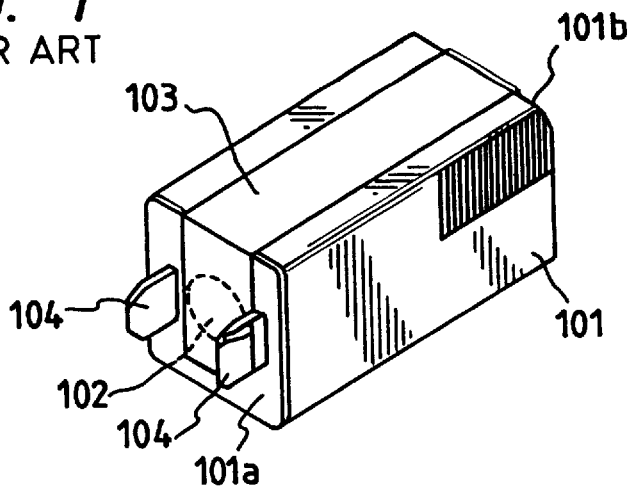
FIG. 1 PRIOR ART
FIG. 1 is a perspective view which schematically shows an ink tank conventionally used, and its sealing manner.
Figure 2:
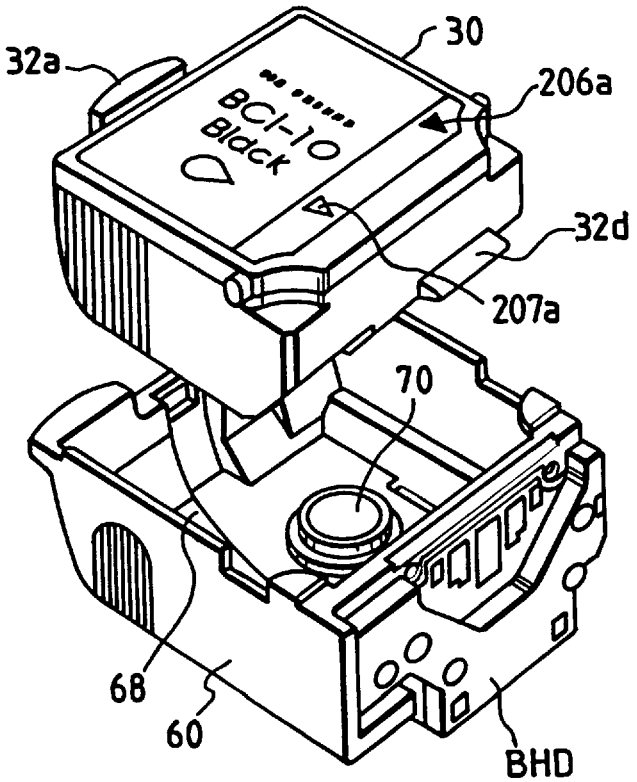
FIG. 2 is a perspective view which shows a head cartridge integrally holding a head (BHD) dedicated to recording in black by housing only a black ink tank.
Figure 3:
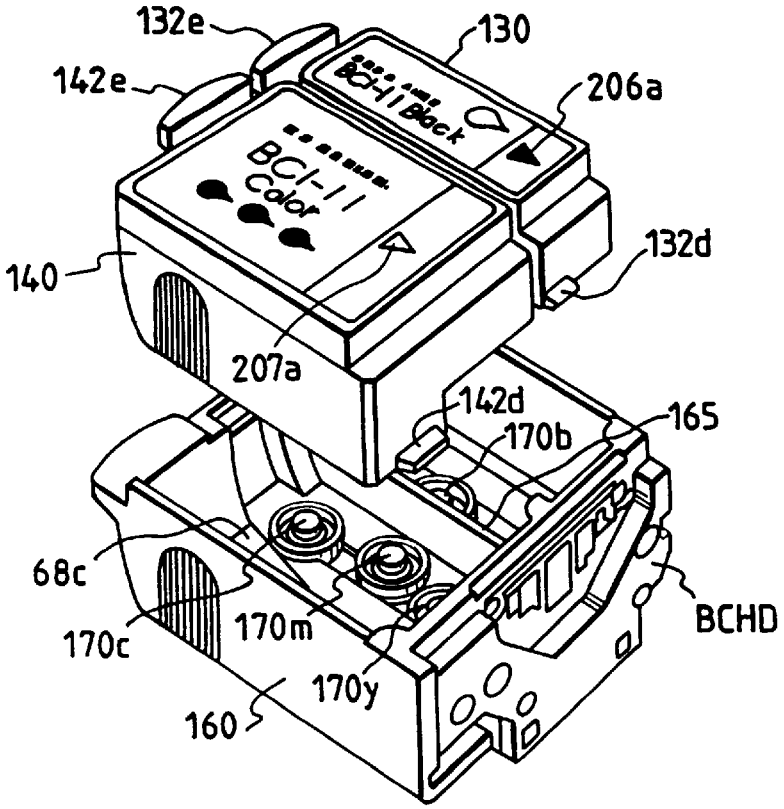
FIG. 3 is a perspective view which shows a head cartridge housing a black and color ink tank and integrally holding a head (BCHD) recording in black and color.
Figure 7:
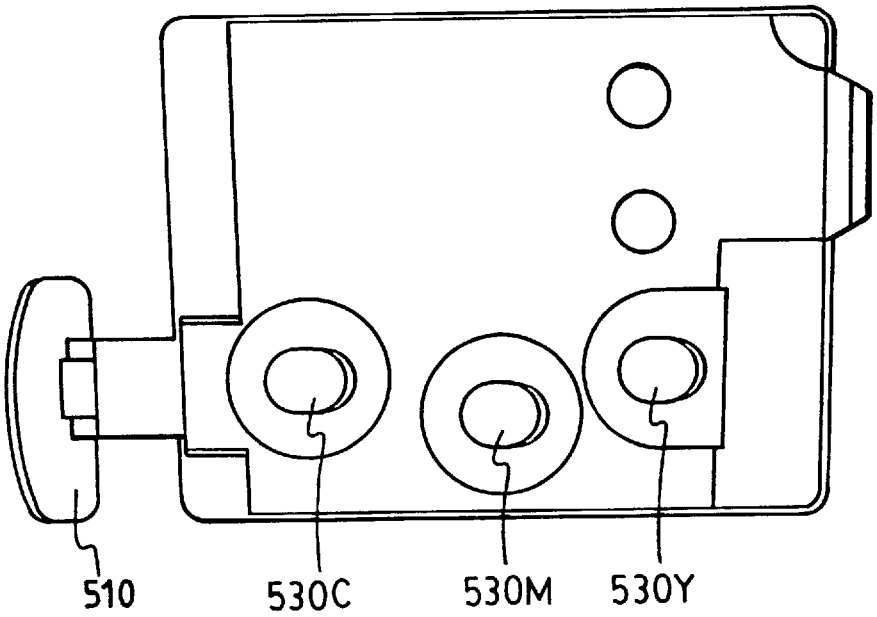
FIG. 7 is a bottom view of an ink tank for color printing use.

FIG. 7 is a bottom view of the ink tank for color printing shown in FIG. 2.

In accordance with the present embodiment, as shown in FIG. 7, an elastic latch nail 510 is substantially aligned in a line with the ink supply openings 530C, 530M, and 530Y each for different colors, and therefore it is possible to easily apply an ink tank protection member formed by a single member.

As the ink tank protection member, it is preferable to use an elongated member such as an adhesive sealing tape or elastically deformative member of such a structure as described above.

Here, by forming the ink tank for color printing use in which the ink supply openings for the respective colors of the ink tank are substantially aligned in a line with the elastic latch nail, it is possible to prevent ink leakage by use of the ink tank protection member that has been formed by a single member. Also, it is possible to protect the elastic latch nail at the same time. Further, by the structure thus arranged, the user can easily peel off the protection member by one action.

Figure 11:
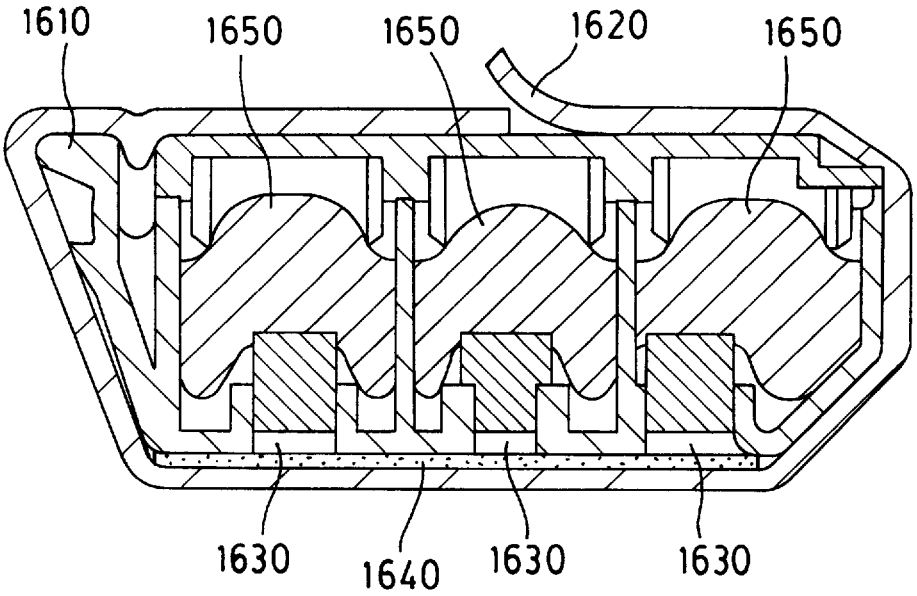
FIG. 11 shows an ink tank with a plurality of chambers and a plurality of ink supply openings, in which at lest one of the ink supply openings is sealed by a sealing member.

For example, FIG. 11 shows an ink tank with a plurality of chambers 1650 and a plurality of ink supply openings 1630, in which at least one of the ink supply openings 1630 is sealed by a sealing member 1640. The sealing member is part of an ink tank protection member including a fixing portion 1610 and a connection portion 1620.

(Third Embodiment)

As a third embodiment, an ink tank protection member provided with a shock relieving material arranged for the portion where the ink tank protection member faces the ink supply opening of an ink tank.

Figure 8:
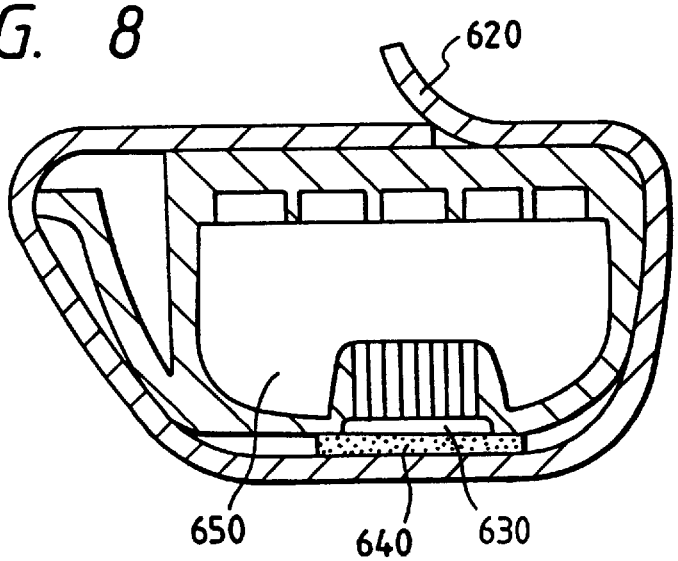
FIG. 8 is a side view schematically showing, as still another example of an ink tank protection member to which the present invention is applicable, an ink tank protection member having a shock relieving member provided on a portion thereof where it abuts upon the supply opening of the ink tank.

FIG. 8 is a view for showing a state where a shock relieving material is provided for the portion of an ink tank protection member facing the ink supply opening of an ink tank.

In accordance with the present embodiment, the ink tank protection member is provided with a shock relieving member 640 formed by an absorber that performs shock absorption in a position of the sealing tape 620 facing the ink supply opening 630 of the ink tank 650, and then, when applying the sealing tape to the ink tank, the ink supply opening of the ink tank 650 is closed by means of the shock relieving member.

In this way, if any external shock is given, the shock relieving member 640 absorbs it to minimize the amount of ink splash from the ink tank 650.

Also, by forming the shock relieving member with an absorbent, even if an ink should be caused to splash into the capping face due to a strong external shock, the ink is absorbed thereby. Therefore, it is possible to prevent the ink tank from being stained during its delivery or prevent an ink from splashing at the time of removing the sealing member. As the absorptive shock releiving member, it is preferable to use an elastic porous material with continuous bubbles, an elastic porous material with individual bubbles, a urethane sponge, elastic unwoven textile, cardboard for use of a corrugated carton, or the like.

Figure 9A:
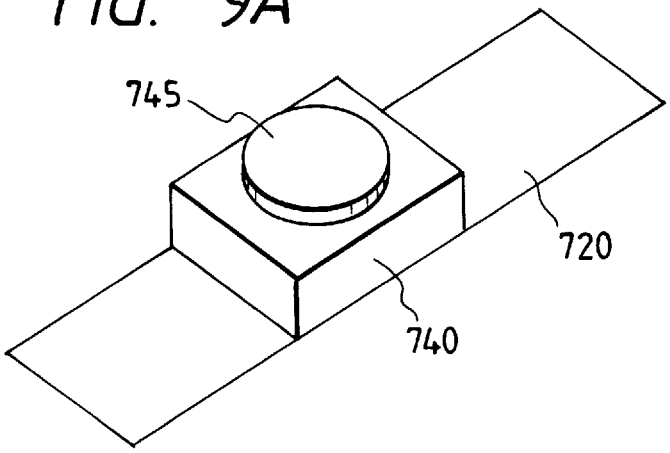
FIGS. 9A and 9B are views showing another example of an ink tank protection member using a capping type shock relieving member.
Figure 9B:
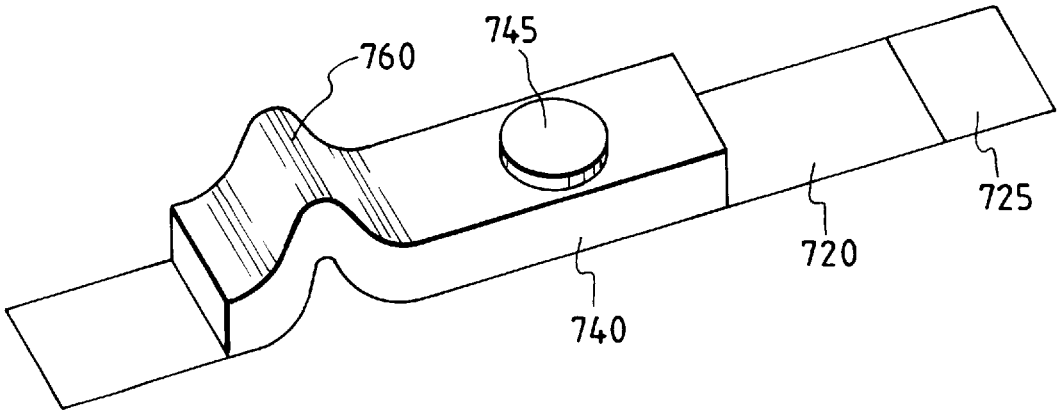

FIGS. 9A and 9B illustrate an ink tank protection member using a capping type shock releiving member: FIG. 9A is a view showing the ink tank protection member; and FIG. 9B is a view showing a state that an elastic latch nail fixing member attached to the ink tank protection member represented in FIG. 9A.

As shown in FIG. 9A, a non-absorptive member is used as a shock releiving member, which is provided with a capping portion 745 whose configuration matches with the ink supply opening of an ink tank. By this member, the ink supply opening is closed so as to prevent ink leakage. Here, it is preferable to adopt an elastic material such as elastomer, solid rubber as a non-absorptive member.

Also, even for such ink tank protection member as described above, it is possible to prevent ink leakage, and at the same time, to protect the elastic latch nail by integrally forming an elastic latch nail fixing member 760. In this embodiment, the shock releiving member 740 and the elastic latch nail fixing member 760 may be structured by one and the same material, or these members may be formed separately by different materials as a matter of course if only the materials to be used can satisfy the respective functions.

Here, in this case, it is preferable to wind the sealing tape 720 used as ink tank protection member around the ink tank with some additional overlap, as described previously. The sealing tape may advantageously be provided with a tab portion 725 so that a user may easily peel off the sealing tape.

(Fourth Embodiment)

As a fourth embodiment, an example in which an ink tank protection member is formed integrally with a sealing member for sealing an atmosphere communicating groove arranged on the upper surface of an ink tank.

Figure 10A:
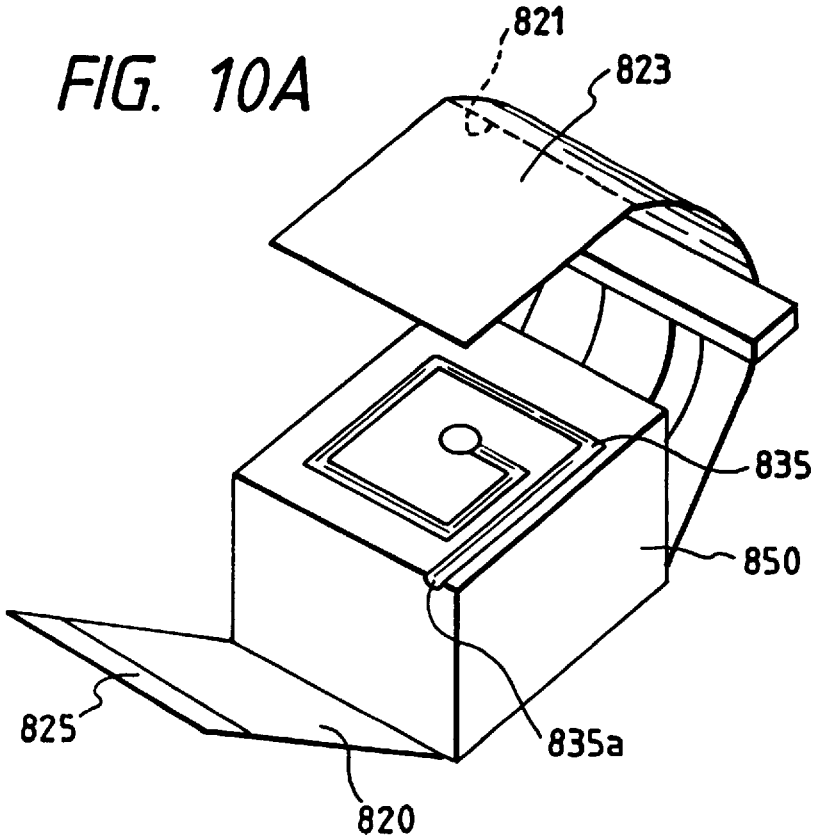
FIGS. 10A and 10B are views showing an ink tank protection member, which is integrated with a sealing member for sealing the atmosphere communicating groove provided on the upper face of the ink tank.
Figure 10B:
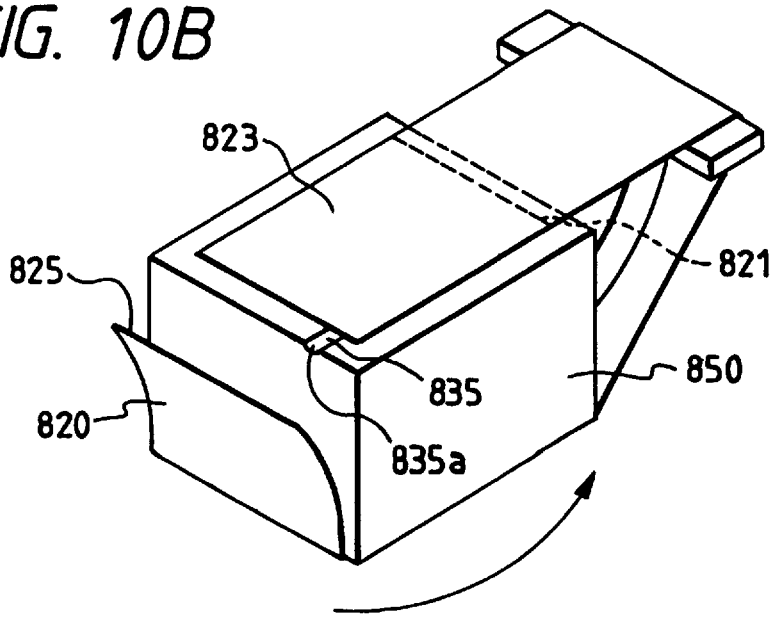

FIGS. 10A and 10B are views showing the ink tank protection member formed together with the sealing member for sealing the atmosphere communicating groove arranged on the upper surface of the ink tank: FIG. 10A illustrates a method to be used for the member at the time of being applied; and FIG. 10B shows a state where the ink tank protection member is applied to dually performing its function as the elastic latch nail fixing member.

In case of the detachably mountable ink cartridge or ink tank, there is provided an atmosphere communicating groove 835 for the ink tank 850 as shown in FIG. 10A in order to prevent ink from being evaporated from an atmosphere communicating orifice portion, and then, in this case, the atmosphere communicating groove 835 is sealed by the sealing member 825 for sealing the atmosphere communicating groove. In this way, it is possible to provide atmosphere communicating means without any ink leakage.

In the present embodiment, by forming the sealing member 823 for sealing the atmosphere communicating groove and the sealing tape for use of closing the supply opening of the ink tank by a single member, it is possible to easily manufacture the protection member at a low cost. Also, it is easy for the user to peel off the sealing tape.

As a method for applying the sealing tape 820 to the ink tank 850, the sealing member 823 for sealing an atmosphere communicating groove is affixed to the upper surface of an atmosphere communicating groove 835 of an ink tank 850 as shown in FIG. 10A, and then, the remaining portion of the sealing tape 820 is wound around the ink tank 850 so as to be affixed thereto. Additionally, for the sealing tape 820, a perforation 821 is provided for the sealing member 823 for sealing the atmosphere communicating groove.

As a method for peeling off the sealing tape 820 from the ink tank 850, the tab portion 825 is pulled to gradually peel off the sealed portion as shown in FIG. 10B. In this respect, the perforation 821 is arranged for the sealing tape 820 such that, when the sealing tape 820 is peeled off, the sealing member 823 for sealing the atmosphere communicating groove still remains affixed to the ink tank 850. The sealing tape 820 is cut off at the perforation 821, thus allowing the sealing member 823 for sealing the atmosphere communicating groove to remain on the ink tank 850. Here, in a state that the sealing tape is applied to the ink tank, the external opening 835*a* of the atmosphere communicating groove 835 is sealed, thus making it possible to seal the external opening 835*a* for sealing the atmosphere communicating and the ink supply opening in good condition, both of them.

As described above, the sealing tape for sealing the atmosphere communicating groove, the sealing tape for sealing the ink supply opening, and the sealing tape for sealing elastic latch nail protection are constituted by means of a single member. Therefore, it is possible to simply manufacture an ink tank protection member at a low cost. Also, it is easy for the user to peel off the tape by one action. Thus the ink tank protection member having good operativity is obtained. Here, for the present embodiment, the description has been made by exemplifying a structure in which no elastic latch nail fixing member is provided for the sealing tape, but the elastic latch nail fixing member may be provided for the tape as a matter of course.

The present invention as has been described have the following effects.

The closing of the ink supply opening and the substantially fixed holding of the elastic latch nail are performed by one and the same means. Therefore, the processing steps of manufacture can be reduced, making it possible at a low cost to prevent ink leakage from the supply opening of an ink tank and protecting the elastic latch nail from external shocks at the same time. The user can also remove the protection member easily by one action at the time of using an ink tank.

A member for fixing an elastic latch nail is provided between the elastic latch nail and the wall face of an ink tank to thereby protect the elastic latch nail from external shocks, and therefore make it possible to prevent the elastic latch nail from being deformed or damaged.

Since an ink tank protection member is sealed over more than four faces of an ink tank, it is possible to effectively prevent the ink tank protection member from becoming loose or slackened due to shocks given during the delivery or the environmental changes such as changes of the temperature and humidity.

By providing a shock releiving member in the position facing the ink supply opening at the time of applying the ink tank protection member to an ink tank, it is possible to minimize ink splashing from the ink supply opening due to external shocks when the ink tank is delivered or left in a state of being unmounted, hence preventing the reduction of the amount of usable ink available to the user. Since the shock releiving member has a shape almost equal to the configuration of the ink supply opening of an ink tank, it is possible to minimize ink leakage from the ink supply opening.

What is claimed is:

1. A method of protecting an ink tank, the ink tank being attachable to and detachable from a holder provided with an ink jet head, the ink tank having a container body, an ink supply opening provided at a bottom of the container body in use, an engaging portion provided on a first side surface of the container body for engaging with a first part of the holder to ensure attachment of the ink tank to the holder, and an elastically deformable elastic latch lever for attaching the ink tank to the holder and detaching the ink tank from the holder, the elastic latch lever provided on a second side surface of the container body, having a first end and a second end, and having an engaging portion integral with the second end for engaging with a second part of the holder to ensure the attachment, the first end of the elastic latch lever fixed on the container body and the second end of the latch lever being displaceable with respect to the container body, the method comprising the steps of:

sealing the ink supply opening by a protection member; and substantially preventing displacement of the elastic latch lever with respect to the container body by aid protection member.

2. An ink tank protection member for protecting an ink tank, the ink tank being attachable to and detachable from a holder provided with an ink jet head, the ink tank having a container body, an ink supply opening provided at a bottom of the container body in use, an engaging portion provided on a first side surface of the container body for engaging with a first part of the holder to ensure attachment of the ink tank to the holder, and an elastically deformable elastic latch lever for attaching the ink tank to the holder and detaching the ink tank from the holder, the elastic latch lever provided on a second side surface of the container body, having a first end and a second end, and having an engaging portion integral with the second end for engaging with a second part of the holder to ensure the attachment, the first end of the elastic latch lever fixed on the container body and the second end of the latch lever being displaceable with respect to the container body, the ink tank protection member comprising:

a sealing portion for sealing the ink supply opening;

a fixing portion for substantially preventing displacement of the elastic latch lever with respect to the container body; and a connecting portion integrally connecting said sealing portion to said fixing portion.

3. An ink tank protection member according to claim 2, wherein said sealing portion, said fixing portion, and said connecting portion integrally form one member.

4. An ink tank protection member according to claim 2, wherein said fixing portion is a shock relieving member to be positioned between the container body and the elastic latch lever to prevent any substantial displacement of the elastic latch lever toward the container body.

5. An ink tank protection member according to claim 4, wherein the shock relieving member comprises an elastic material selected from the group consisting of an elastomer and rubber.

6. An ink tank protection member according to claim 2, wherein said connecting portion is a sheet member.

7. An ink tank protection member according to claim 2, wherein said connecting portion is an elastic rubber sheet member.

8. An ink tank protection member according to claim 2, wherein said sealing portion is a shock relieving member which comprises a material selected from the group consisting of an elastic porous material with continuous bubbles, an elastic porous material with individual bubbles, a urethane sponge, an elastic unwoven textile, a corrugated cardboard, an elastomer and rubber.

9. An ink tank protection member according to claim 8, wherein said sealing portion has a shape substantially identical to that of the ink supply opening.

10. An assembly comprising an ink tank and an ink tank protection member for protecting said ink tank, said ink tank being attachable to and detachable from a holder provided with an ink jet head, said ink tank comprising:

a container body, an ink supply opening provided at a bottom of said container body in use, an engaging portion provided on a first side surface of said container body for engaging with a first part of the holder to ensure attachment of said ink tank to the holder, and an elastically deformable elastic latch lever for attaching said ink tank to the holder and detaching said ink tank from the holder, said elastic latch lever provided on a second side surface of said container body, having a first end and a second end, and having an engaging portion integral with the second end for engaging with a second part of the holder to ensure the attachment, the first end of said elastic latch lever fixed on said container body and the second end of said elastic latch lever being displaceable with respect to said container body, said ink tank protection member comprising:

a sealing portion sealing said ink supply opening;

a fixing portion positioned between said container body and said elastic latch lever for substantially preventing displacement of said elastic latch lever with respect to said container body; and a connecting portion integrally connecting said sealing portion to said fixing portion.

11. An assembly according to claim 10, wherein said ink tank has an interior and said ink tank is provided with an atmosphere communicating opening whereby the interior of said ink tank communicates with atmosphere, and wherein said ink tank protection member is capable of being attached to said ink tank to also seal the atmosphere communicating opening and being removed from said ink tank to allow the interior of said ink tank to communicate with the atmosphere.

12. An assembly according to claim 10, wherein said ink tank houses an ink of one color.

13. An assembly comprising an ink tank and an ink tank protection member for protecting said ink tank, said ink tank being attachable to and detachable from a holder provided with an ink jet head, said ink tank comprising:

a container body having an interior divided into a plurality of chambers;

an engaging portion provided on a first side surface of said container body for engaging with a first part of the holder to ensure attachment of said ink tank to the holder;

an elastically deformable elastic latch lever for attaching said ink tank to the holder and detaching said ink tank from the holder, said elastic latch lever provided on a second side surface of said container body, having a first end and a second end, and having an engaging portion integral with the second end for engaging with a second part of the holder to ensure the attachment, the first end of said elastic latch lever fixed on said container body and the second end of said elastic latch lever being displaceable with respect to said container body; and a plurality of ink supply openings provided at a bottom of said container body, said ink supply openings corresponding respectively to said chambers, each of said chambers being capable of housing an ink of a different color, the plurality of ink supply openings arranged substantially on a line connecting the engaging portion provided on said first side surface and said elastic latch lever, said ink tank protection member comprising:

a sealing portion sealing at least one of said ink supply openings;

a fixing portion positioned between said container body and said elastic latch lever for substantially preventing displacement of said elastic latch lever with respect to said container body; and a connecting portion integrally connecting said sealing portion to said fixing portion.

* * * * *